United States Patent [19]

Tagawa

[11] Patent Number: 4,781,366

[45] Date of Patent: Nov. 1, 1988

[54] MACHINE FOR EXTENDING ROLLED CLOTH

[76] Inventor: Keiko Tagawa, 14-1, Hon-mach 6-chome, Toyonaka-shi, Osaka, Japan

[21] Appl. No.: 893,929

[22] Filed: Aug. 6, 1986

[30] Foreign Application Priority Data

Aug. 9, 1985 [JP] Japan ..... 60-176008

[51] Int. Cl.[4] ..... B65H 29/46

[52] U.S. Cl. ..... 270/31; 242/62

[58] Field of Search ..... 270/30–31; 242/62

[56] References Cited

U.S. PATENT DOCUMENTS

| | | | |
|---|---|---|---|
| 3,468,529 | 9/1969 | Martin, Sr. et al. | 270/31 |
| 3,503,604 | 3/1970 | Martin et al. | 270/31 |
| 3,811,669 | 5/1974 | Benson et al. | 270/31 |
| 3,850,424 | 11/1974 | Fonio | 270/31 |
| 4,262,893 | 4/1981 | Sgroi | 270/31 |
| 4,380,330 | 4/1983 | Smith et al. | 270/31 |
| 4,477,065 | 10/1984 | Smith et al. | 270/31 |

*Primary Examiner*—E. H. Eickholt

*Attorney, Agent, or Firm*—Wenderoth, Lind & Ponack

[57] ABSTRACT

The present invention relates to a machine for extending rolled cloth, which is used for unrolling rolled cloth, cutting the unrolled cloth into a fixed length and piling the cut cloth. The machine for extending rolled cloth includes a machine body provided with wheels and a driving source, a rolled cloth-holding stand, a cloth-supplying device provided with a drawing-out roller, a cutter and an ascending and descending device. When the cloth-extending operation is performed, the cloth-supplying portion and the cutter are moved up and down relative to the machine body by the ascending and descending device in accordance with the height of piled cloth.

2 Claims, 3 Drawing Sheets

MACHINE FOR EXTENDING ROLLED CLOTH

BACKGROUND OF THE INVENTION

1. Field of the Invention

The present invention relates to a machine for unrolling rolled cloth, cutting unrolled cloth into a fixed length and piling the cut cloth.

2. Description of the Related Art

The conventional cloth-extending machine comprises, as shown in FIG. 4, a machine body 10 provided with wheels 12*a*, 12*b* running on a cloth-extending stand 1 and a driving means such as a motor (not shown in the drawing), a rolled cloth-holding stand 20 supporting a roll of cloth to be subjected to cloth-extending, and a cutting means 30 for cutting the cloth 2 into fixed lengths. In the machine body 10, guide rolls 14, 15 are provided for guiding cloth 2 supplied from the cloth-holding stand 20 in the upward portion, and a drawing-out roller 17 is provided for sending out cloth 2 onto the cloth-extending stand 1 through a cloth-sliding plate 36 of the cutting means 30 disposed on the front end thereof. On receiving portions of the rolled cloth-holding stand 20, cores of the roll are supported on which cloth to be extended is rolled, and a roller for unrolling cloth 3 is provided on its front end, whereby the starting rolled cloth 3 is unrolled, and the unrolled cloth 2 is sent forward, i.e. to the cloth-extending portion of the cloth-extending machine. On the cutting means 30, a cutter 31 for cutting cloth is provided which moves in the vertical direction against the cloth-extending direction so as to cut the cloth 2 extended on the cloth-extending stand from the cloth-sliding plate 36. In the above-described construction, the cloth-extending operation is effected as follows: the starting rolled cloth 3 is unrolled by the cloth-unrolling roller 29; the cloth 2, with the aid of the guide rolls 14, 15, is drawn out on the cloth-extending stand 1 through the cloth-sliding plate 36 of the cutting means 30 by rotation of the drawing-out roller 17 which rotates at the same speed as the machine body 10. During this operation, the machine body 10 moves over a fixed distance on the cloth-extending stand 1, and after the cloth 2 is cut by the cutter 31 of the cutting means 30 into a fixed length, the machine body 10 returns to the starting position. Thus, the cloth-extending operation is repeated.

In the conventional cloth-extending machine, however, since the drawing-out roller 17 for drawing out the cloth 2 on the cloth-extending stand 1 is fixed on the front upper portion of the machine body 10, a long portion of the cloth 2 hangs between the drawing-out roller 17 and the cloth-sliding plate 36 of the cutting means 30. The hanging cloth is apt to be affected by wind, etc., which causes the cloth 2 to shift in the lateral direction, or causes folds or slackness to be produced in the cloth 2.

SUMMARY OF THE INVENTION

An object of the present invention is to overcome the above-described drawbacks of the prior art by providing a cloth-extending machine in which the distance between the drawing-out roller and the cloth-extending stand, i.e. the distance in which cloth hangs, is maintained as short as possible, so that slack cloth can be prevented. For attaining this object, in the cloth-extending machine of the present invention, a drawing-out roller and a cloth-supplying portion integrated with a cloth-holding stand, a cutting means, etc. can move up and down, whereby the cloth-supplying portion moves up and down in accordance with the height of piled cloth and the distance of cloth hanging from the drawing-out roller can be kept fixed so as to to prevent slack in the cloth.

DESCRIPTION OF THE PREFERRED EMBODIMENTS

The above and other objects of the present invention will be explained by way of example as shown in the accompanying drawings.

Figure 1:
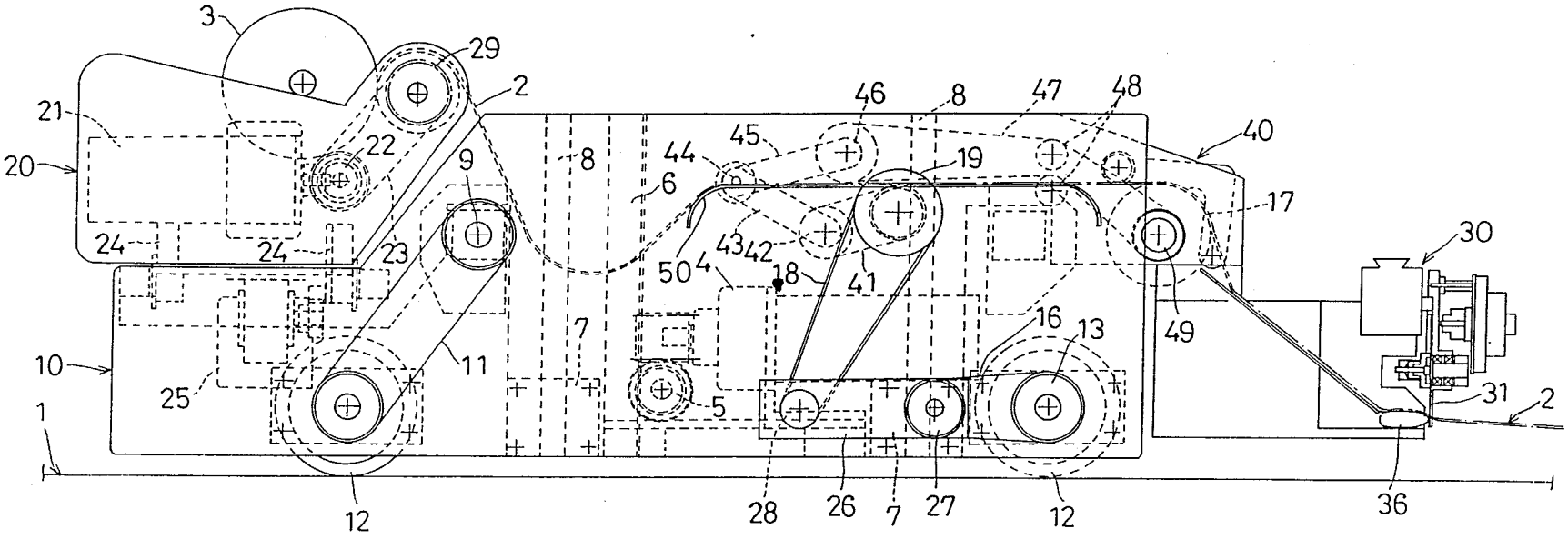
FIG. 1 is a side view of the cloth-extending machine showing one embodiment of the present invention.
Figure 2:
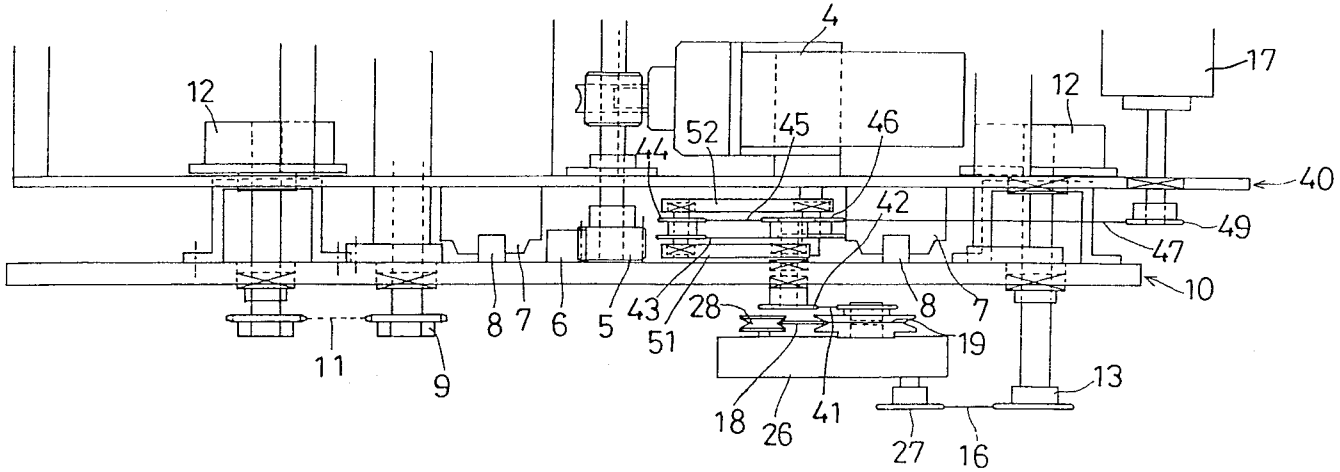
FIG. 2 is a plan view of the cloth-extending machine of FIG. 1.
Figure 4:
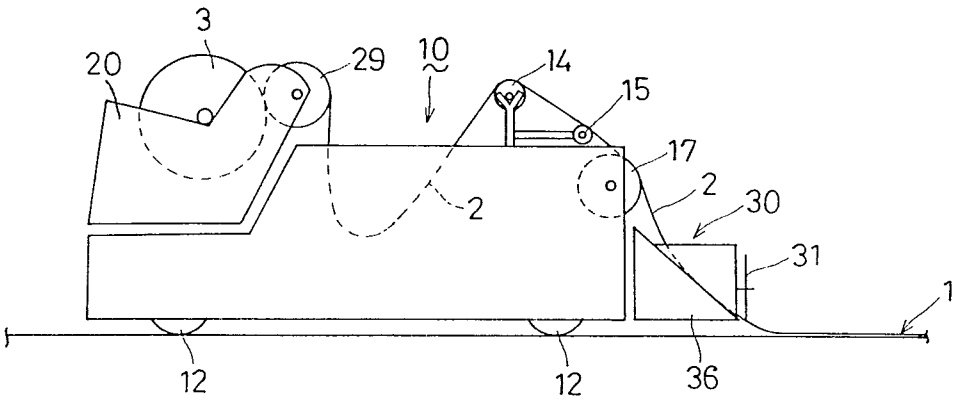
FIG. 4 is a simplified side view of a conventional cloth-extending machine.

As shown in FIGS. 1 and 2, the cloth-extending machine of the present invention comprises a machine body 10, a rolled cloth-holding stand 20, a cutting means 30, an ascending and descending means, which is one of the essential features of the present invention, and a cloth-supplying portion 40 integrated with the cloth-holding stand 20, the cutting means, etc.

On the machine body 10 is a motor (not shown in the drawing) for driving the machine body, which rotates a back wheel 12*a* through a sprocket 9. The driving force of a front wheel 12*b* is transmitted from a sprocket 13 to a sprocket 27 of a gear box 26 through a chain 16, and then from a pulley 28 of the gear box to a drawing-out roller 17 through a belt 18, a changing gear 19, a chain 41, a sprocket 42, a chain 43, a sprocket 44, a chain 45, a sprocket 46, a chain 47, a guide rod 48 and a sprocket 49, whereby a rotating force that is generated during the running of the machine body 10 is transmitted to the drawing-out roller 17.

On the front end of the cloth-supplying portion 40, the drawing-out roller 17 is fixed. At the back of the drawing-out roller a guide 50 for guiding cloth is arranged. On the both of the side plates 60 of the cloth-supplying portion, a slide block 7 is provided for moving the cloth-supplying portion up and down and defines part of an ascending and descending means. When the motor 4 rotates, the rotation is transmitted to a pinion 5 through a worm and wheels. Engagement of the pinion 5 with a rack 6 causes the slide block 7 to slide along a truck rail 8 provided on the machine body 10, whereby the cloth-supplying portion 40 moves up and down together with the cloth-holding stand 20 and the cutting means 30. By driving motor 25 for regulating the selvage of cloth provided on the back end of the machine body, the rolled cloth-holding stand 20 is moved horizontally in the vertical direction against the cloth-extending direction so as to regulate the selvage of cloth to be supplied.

On the rolled cloth-holding stand 20, a cloth-unrolling roller 29 is installed which is drived by a rotational force transmitted from a driving motor 21 through a gear 22 and a chain 23.

Figure 3:
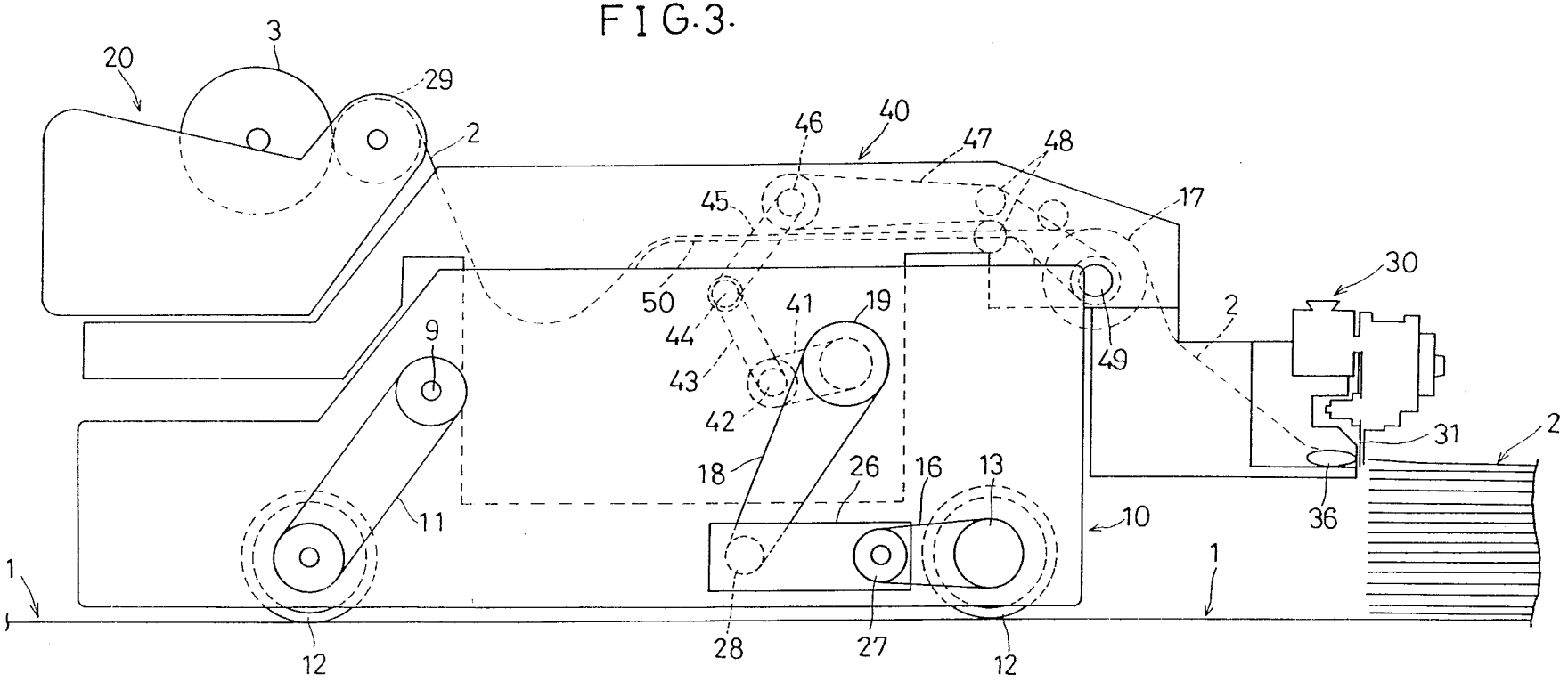
FIG. 3 is a side view of the cloth-extending machine of FIG. 1 showing an operative condition.

Operation of the cloth-extending machine of the present invention having the above-described construction is as follows. Cloth 2 is supplied by rotation of the drawing-out roller 17, and as the height of supplied cloth 2 increases, as shown in FIG. 3, the rolled cloth-holding stand 20 and the cutting means 30 move upward together with the cloth-supplying portion 40 provided with the drawing-out roller 17. Accordingly, the drawing-out roller 17 moves upward while rotating during the running of the machine body 10. Since sprockets 42, 44 are connected with crank 51 and sprockets 44, 46 are connected with crank 52, the hanging distance of the cloth 2 between the drawing-out roller 17, which can transmit a rotational force which assuredly feeds the cloth, and the cloth-sliding plate 36 of the cutting means 30 and the cloth-extending portion can always be kept fixed and as short as possible. Accordingly, since the length of hanging cloth from the drawing-out roller to the cloth-sliding plate 36 and the cloth-extending portion is very short, slackness of the cloth, influence by wind, etc. can be prevented, and, in addition the stacked condition of the piled cloth can always be maintained regardless of the height of the piled cloth, whereby cloth-extending operation can be effected stably.

In the embodiment discussed above, the up and down movement of the cloth-supplying portion 40 is effected by a motor 4 for driving the cloth-supplying portion 40 up and down. Alternatively, the driving source for up and down movement may be an oil pressure or an air type. Furthermore, the drawing-out roller is rotated by the running of the machine body 10 in such a manner that the rotation of the wheel 12 is transmitted by sprockets 13, 27, 42, 44, 46 and 49, gear box 26, pulley 28, belt 18, changing gear 19, and chains 16, 41, 43, 45 and 47. Alternatively, a synchronous motor may be used for driving the drawing-out roller 17 when the machine body 10 runs.

Between the cloth-unrolling roller 29 and the drawing-out roller 17, there is provided a cloth-sliding guide 50, on the center of which a timing belt (not shown in the drawings) is rotated so as to remove folds on the cloth travelling over the guide. Instead of the guide 50, a conveyor belt having a length that is adjustable so as to be able to extend or retract could be provided, whereby as cloth passes thereon, folds on the cloth can be removed. Of course a conventional guide roll can be used instead of the guide 50. As to the method for unrolling cloth, in the embodiment of the present invention, unrolling of cloth is effected by contacting the rolled cloth with the cloth-unrolling roller 29. Instead of this method, unrolling of the cloth can be effected without contacting the rolled cloth with the cloth-unrolling roller.

In the cloth-unrolling machine of the present invention, main control circuits, base plates, etc. are arranged on the down side of the machine body 10, and therefore, removal or setting up of these members can easily be effected. Accordingly if the machine is out of order, any broken members can be exchanged with new ones easily.

What is claimed is:

1. A cloth-extending machine comprising:

a machine body having running wheels, and a driving means for driving the machine body on the running wheels thereof;

a rolled cloth-holding stand for supporting a roll of cloth;

a cloth-supplying portion movably mounted to the machine body so as to be movable vertically relative to the machine body, said cloth-supplying portion including a rotatable drawing-out roller for feeding the cloth in a feeding direction from the roll thereof, and a cloth-sliding guide means between the rolled cloth-holding stand and the drawing out roller for guiding the cloth extending therebetween as the cloth is fed from the roll by said drawing-out roller;

a cutting means disposed downstream of said drawing-out roller with respect to said feeding direction so as to receive the cloth fed by said drawing-out roller, said cutting means for cutting the received cloth into predetermined lengths; and an ascending and descending means operatively connected to said cloth-supplying portion and said cutting means for moving the cloth-supplying portion and the cutting means in up and down vertical directions relative to said machine body and for moving the cloth-sliding guide means and the cloth-holding stand in said up and down vertical directions.

2. A cloth-extending machine comprising:

a machine body having running wheels, and a driving means for driving the machine body on the running wheels thereof;

a rolled cloth-holding stand for supporting a roll of cloth;

a cloth-supplying portion movably mounted to the machine body so as to movably vertically relative to the machine body, said cloth-supplying portion including a rotatable drawing-out roller for feeding the cloth in a feeding direction from the roll thereof;

a cutting means disposed downstream of said drawing-out roller with respect to said feeding direction so as to receive the cloth fed by said drawing-out roller, said cutting means for cutting the received cloth into predetermined lengths;

an ascending and descending means operatively connected to said cloth-supplying portion and said cutting means for moving the cloth-supplying portion and the cutting means in up and down vertical directions relative to said machine body; and a power delivery mechanism including a plurality of belts and pulleys operatively connected between at least one of the running wheels and said drawing-out roller for transmitting rotation of said at least one of the running wheels to the drawing-out roller so as to rotate the drawing-out roller when machine body is driven by said driving means.

* * * * *